US007918046B2

(12) United States Patent
Cruz

(10) Patent No.: US 7,918,046 B2
(45) Date of Patent: Apr. 5, 2011

(54) PHOTO DISPLAY DEVICE

(75) Inventor: Seymer Cruz, Unionville (CA)

(73) Assignee: Umbra LLC, Buffalo, NY (US)

( * ) Notice: Subject to any disclaimer, the term of this patent is extended or adjusted under 35 U.S.C. 154(b) by 79 days.

(21) Appl. No.: 12/317,818

(22) Filed: Dec. 30, 2008

(65) Prior Publication Data

US 2010/0162603 A1 Jul. 1, 2010

(51) Int. Cl.
*A47G 1/06* (2006.01)

(52) U.S. Cl. ..... 40/720; 40/757; 40/737

(58) Field of Classification Search ..... 40/720, 40/734, 737, 771; 428/7; 359/718, 710, 359/664, 807, 804
See application file for complete search history.

(56) References Cited

U.S. PATENT DOCUMENTS

| | | | | |
|---|---|---|---|---|
| D52,558 | S | | 10/1918 | Buchenau |
| D59,181 | S | | 10/1921 | Buchenau |
| D158,699 | S | | 5/1950 | Wasilevich |
| D213,150 | S | | 1/1969 | McBain |
| D219,895 | S | | 2/1971 | Loewy |
| D220,146 | S | | 3/1971 | Loewy |
| 3,694,648 | A | | 9/1972 | Yates |
| 3,774,332 | A | * | 11/1973 | Schneider ..... 40/720 |
| 3,802,104 | A | | 4/1974 | Wiley |
| 4,116,439 | A | | 9/1978 | Chavarria et al. |
| 4,173,667 | A | | 11/1979 | Rusch |
| 4,180,930 | A | | 1/1980 | DiMatteo |
| 4,224,364 | A | | 9/1980 | Hunt |
| D266,749 | S | | 11/1982 | Sun |
| 4,592,936 | A | | 6/1986 | Ferguson |
| 4,889,748 | A | | 12/1989 | Dudley |
| 5,065,289 | A | * | 11/1991 | Teng ..... 362/101 |
| 5,175,029 | A | | 12/1992 | Peterson |
| 5,226,252 | A | | 7/1993 | Haluska |
| 5,320,345 | A | | 6/1994 | Lai et al. |
| D375,411 | S | | 11/1996 | Hawkins |
| 5,649,874 | A | | 7/1997 | Headford et al. |
| D384,824 | S | | 10/1997 | Johnson |
| 5,688,567 | A | | 11/1997 | Daulton |
| 5,713,147 | A | | 2/1998 | Johnson |
| 5,811,159 | A | | 9/1998 | Chang |
| 6,029,383 | A | | 2/2000 | Zappitelli |
| 6,256,914 | B1 | | 7/2001 | Yeh |
| 6,438,878 | B1 | | 8/2002 | Fine et al. |

(Continued)

FOREIGN PATENT DOCUMENTS

| | | |
|---|---|---|
| DE | 10020186 | 10/2001 |

*Primary Examiner* — Joanne Silbermann
*Assistant Examiner* — Christopher E Veraa
(74) *Attorney, Agent, or Firm* — Simpson & Simpson, PLLC

(57) ABSTRACT

A photo display device including a top portion, a bottom portion having an upper surface and a cuboid member extending upwardly from the upper surface, and a middle portion having a translucent material, an outer surface having an elliptical curvature, a cuboid inner chamber defined by an inner surface and adapted to receive the cuboid member therein, wherein the top portion, the middle portion, and the bottom portion are adapted to be assembled as the photo display device such that the top portion rests upon the middle portion and the middle portion rests upon the bottom portion, and wherein the photo display device is adapted to hold at least one substantially planar item between the cuboid member and the inner surface, and the middle portion is adapted to magnify the at least one substantially planar item when held between the cuboid member and the inner surface.

6 Claims, 12 Drawing Sheets

U.S. PATENT DOCUMENTS

| | | | | |
|---|---|---|---|---|
| D475,930 | S | 6/2003 | Chang | |
| 6,592,706 | B1 | 7/2003 | Malherbe de Juvigny | |
| D494,716 | S | 8/2004 | Chang | |
| 7,166,047 | B2 * | 1/2007 | May et al. | 473/569 |
| D598,808 | S * | 8/2009 | Rosenkotter | D11/121 |
| 2009/0091849 | A1 * | 4/2009 | King | 359/804 |

* cited by examiner

PHOTO DISPLAY DEVICE

FIELD OF THE INVENTION

The invention broadly relates to devices for holding and displaying pictorial items, such as pictures, photographs, and the like.

BACKGROUND OF THE INVENTION

Devices for holding and displaying pictures, photographs, and the like are well known. For example, picture frames and lockets are commonly used to hold and display pictures. Picture frames are generally effective at holding and displaying a wide assortment of pictures. However, picture frames suffer from the drawback that they generally are adapted to display pictures held therein in only one or two directions. Lockets, while effective at holding small pictures, suffer from the drawback that the pictures held therein are not easily viewable due to their small size.

Thus, there is a longfelt need for a device which is adapted to hold and display pictures in more than two directions. There is also a longfelt need for a device which is adapted to hold and display small pictures such that the pictures are easily viewable.

BRIEF SUMMARY OF THE INVENTION

Broadly, the present invention is a photo display device comprising: a top portion; a bottom portion having an upper surface and a cuboid member extending upwardly from the upper surface; a middle portion comprising: a translucent material; a lateral outer surface having an elliptical curvature; a cuboid inner chamber defined by an inner surface and adapted to receive the cuboid member therein, wherein the top portion, the middle portion, and the bottom portion are adapted to be assembled as the photo display device such that the top portion rests upon the middle portion and the middle portion rests upon the bottom portion, and wherein the photo display device is adapted to hold at least one substantially planar item between the cuboid member and the inner surface, and the middle portion is adapted to magnify the at least one substantially planar item when held between the cuboid member and the inner surface.

Preferably, the photo display device is adapted to hold four substantially planar items between the cuboid member and the inner surface, and the middle portion is adapted to magnify each of the four substantially planar items when held between the cuboid member and the inner surface.

In one aspect of the invention, the photo display device produces a unique visual effect wherein pictorial items held between the cuboid member and the middle portion seem to appear and disappear as a user rotates the photo display device while viewing it. Such unique visual effect is produced by the cuboid arrangement of the lateral inner surfaces relative to the elliptical outer surface of the middle portion.

It is a general object of the present invention to provide a photo display device adapted to hold, display, and magnify four pictorial items in four different directions.

It is another object of the present invention to provide such a photo display device which produces a visual effect wherein each of the four pictorial items held and displayed seem to appear and disappear as a user rotates the photo display device while viewing it.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures of an exemplary embodiment thereof, in which.

DETAILED DESCRIPTION OF THE INVENTION

Figure 1:
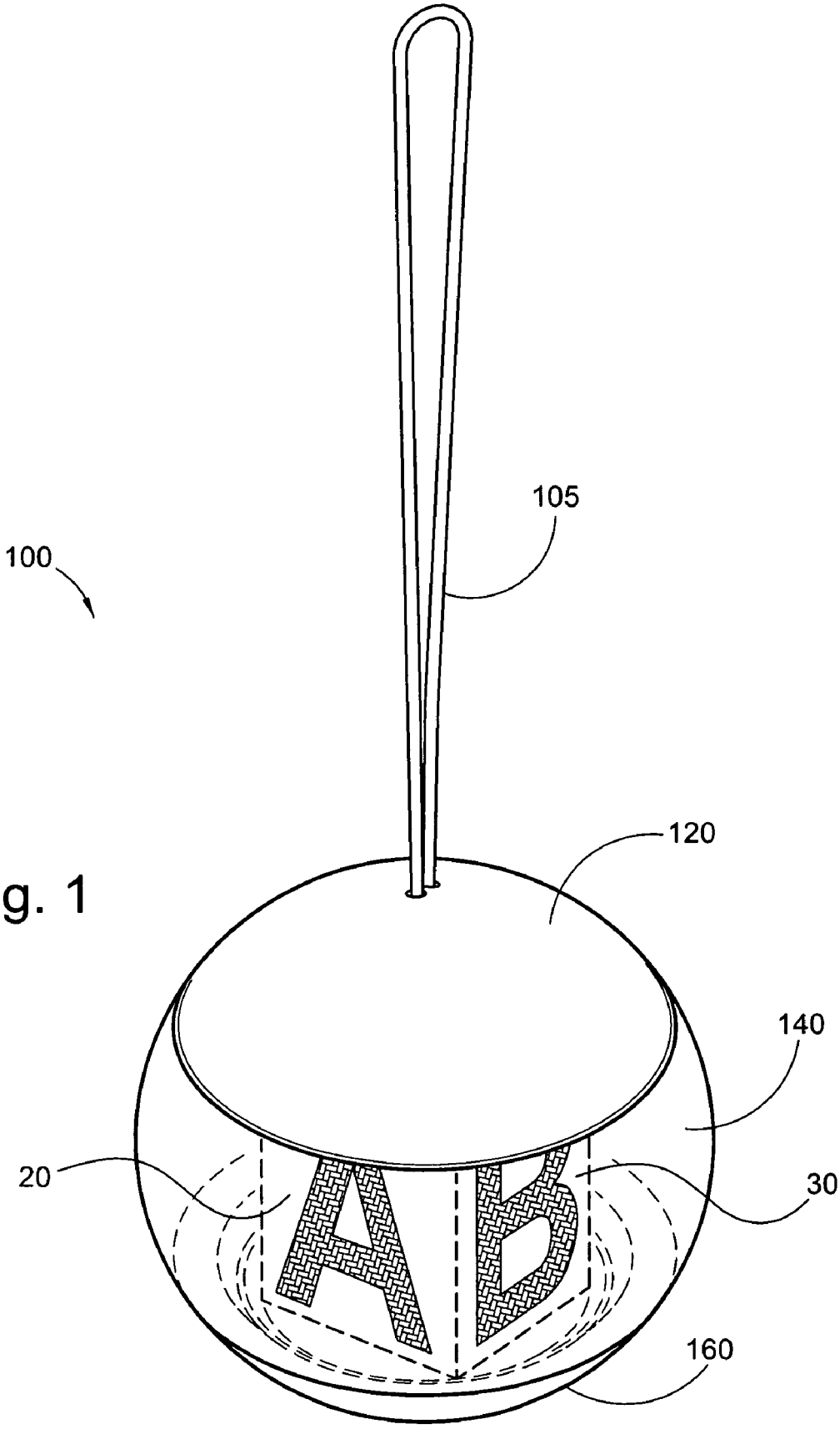
FIG. 1 is a top perspective view of the present invention photo display device.

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "spheroid" when used herein refers to a solid figure bounded by a quadric surface obtained by rotating an ellipse about one of its principal axes, a sphere being a spheroid generated by rotating a circle about its diameter. Accordingly, a spheroid may be: prolate (elongated) if the generating ellipse is rotated about its major axis; oblate (flattened) if the generating ellipse is rotated about its minor axis; or, spherical if the generating ellipse is a circle. Thus, it should be appreciated that, generally, the outer surface of any spheroid body has an elliptical curvature, the outer surface of a sphere having the curvature of a circle, i.e., an arcuate curvature.

It should also be appreciated that the term "spheroid cap" when used herein refers to a portion of a spheroid cut off by a plane passing through the spheroid perpendicularly to the axis about which the generating ellipse is rotated. Additionally, the term "spherical cap" when used herein refers to a portion of a sphere cut off by a plane passing through the sphere, and a spherical cap may be formed by a "small circle", which is the circle constructed by a plane passing through the sphere at any location other than the center of the sphere.

Additionally, the term "cuboid" refers to a polyhedron comprising six faces (hexahedron), each of which is a rectangle, a cube being a cuboid wherein each rectangle is a square.

The term "total internal reflection" refers to an optical phenomenon which occurs when a ray of light strikes a medium boundary at an angle larger than the critical angle with respect to the normal to the surface. If the refractive index is lower on the other side of the boundary no light can pass through, so effectively all of the light is reflected. The term "critical angle" refers to the angle of incidence above which the total internal reflection occurs.

The terms "front", "back", "left", and "right", "top", "bottom", and "lateral", when used herein, are relative terms meant to refer to the viewing perspective of the elements shown in the figures. For example, a "lateral surface" refers to a surface provided by a side of an object, as opposed to the top or bottom.

The present invention photo display device generally comprises a top portion, a bottom portion, and a middle portion. The top portion, middle portion, and bottom portion are adapted to be assembled as the photo display device, such that the top portion rests upon the middle portion, and the middle portion rests upon the bottom portion. The bottom portion includes an upper surface and a cuboid member extending upwardly from the upper surface. The middle portion comprises a translucent material, an outer surface having an elliptical curvature, and a cuboid inner chamber. The cuboid inner chamber is adapted to receive the cuboid member of the bottom portion. The photo display device is adapted to hold a substantially planar item, such as a pictorial item, between the cuboid member and the inner surface of the middle portion, and the middle portion is operatively arranged to magnify the substantially planar item. In one general embodiment of the invention, the photo display device is substantially spheroid having an elliptical outer surface. In a more particular embodiment, the photo display device is substantially spherical having an arcuate outer surface.

The following description is best understood in view of FIGS. 1-20, which illustrate an exemplary embodiment if the present invention photo display device, and/or exemplary embodiments of elements thereof, hereinafter referred to as display device 100.

Figure 2:
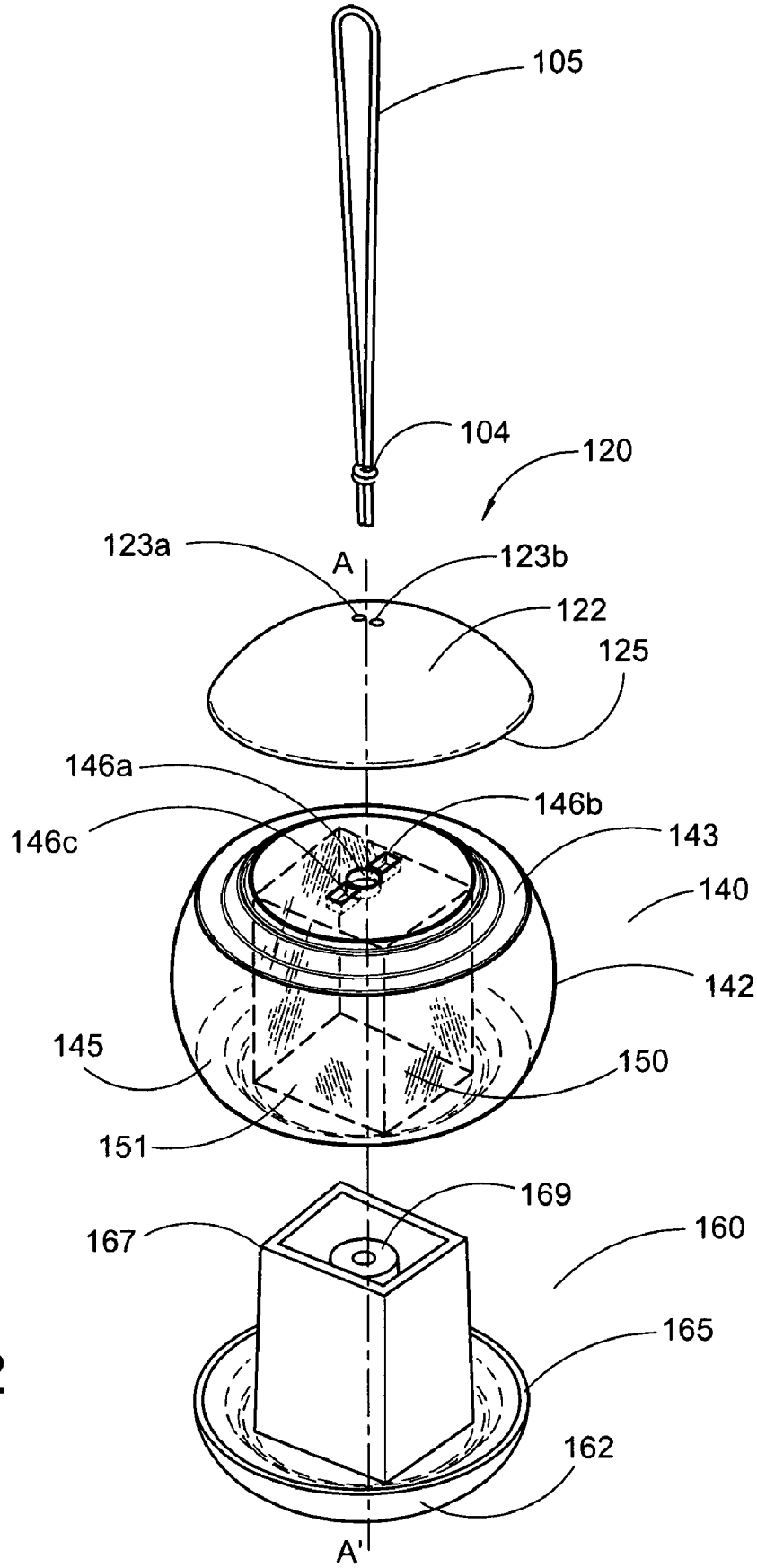
FIG. 2 is an exploded top perspective view of the photo display device.
Figure 3:
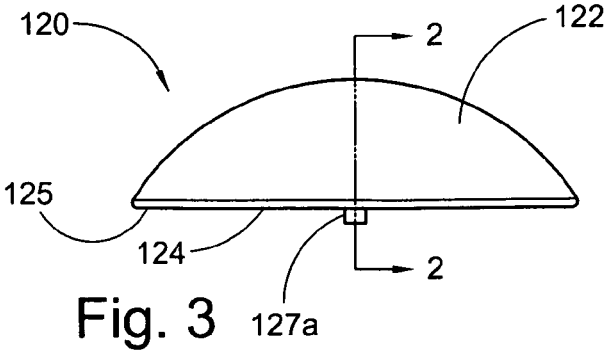
FIG. 3 is a front elevational view of a top portion of the photo display device.
Figure 4:
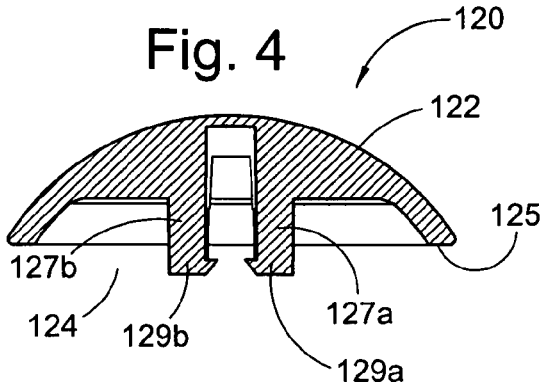
FIG. 4 is a cross-sectional view taken generally along line 2-2 in FIG. 3.
Figure 5:
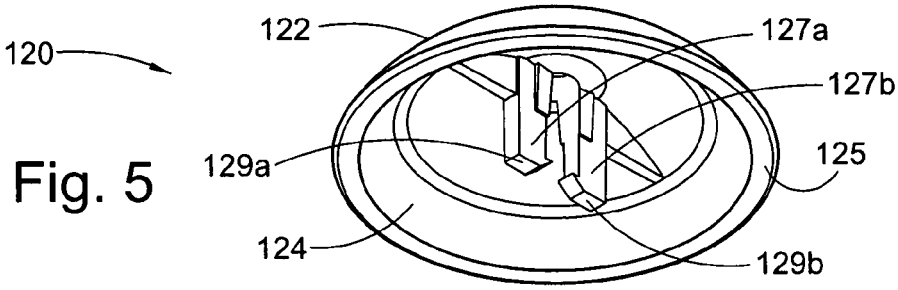
FIG. 5 is a bottom perspective view of the top portion.
Figure 6:
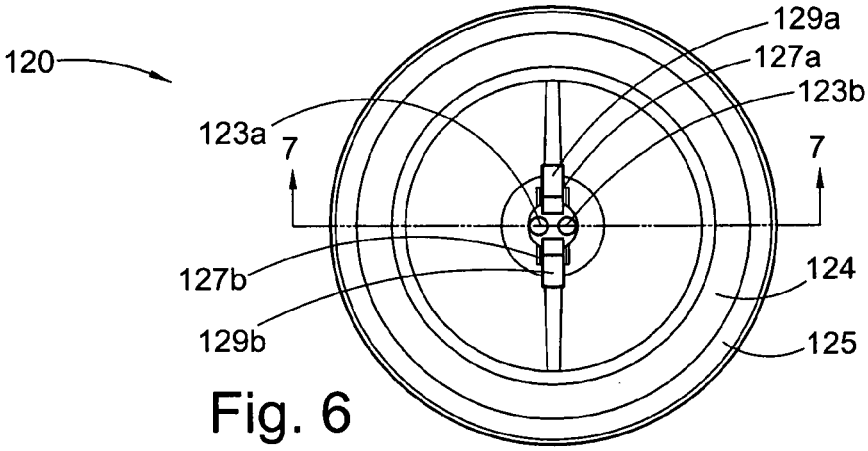
FIG. 6 is a bottom plan view of the top portion.
Figure 7:
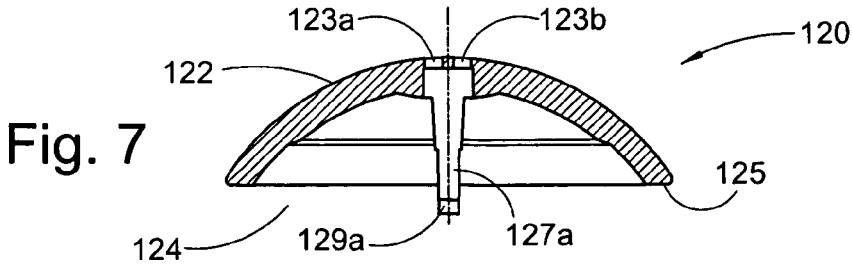
FIG. 7 is a cross-sectional view taken generally along line 7-7 in FIG. 6.
Figure 8:
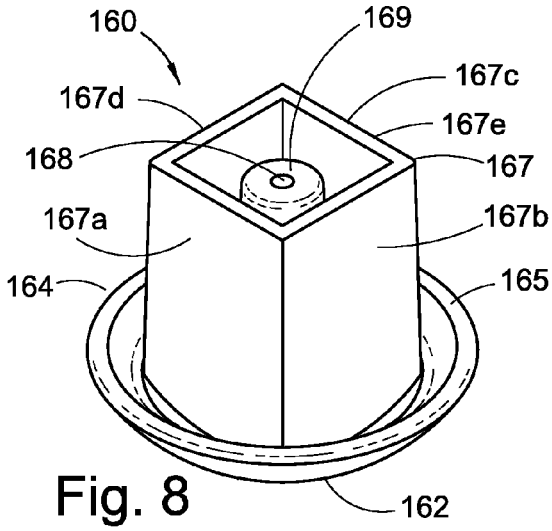
FIG. 8 is a top perspective view of a bottom portion of the photo display device.
Figure 9:
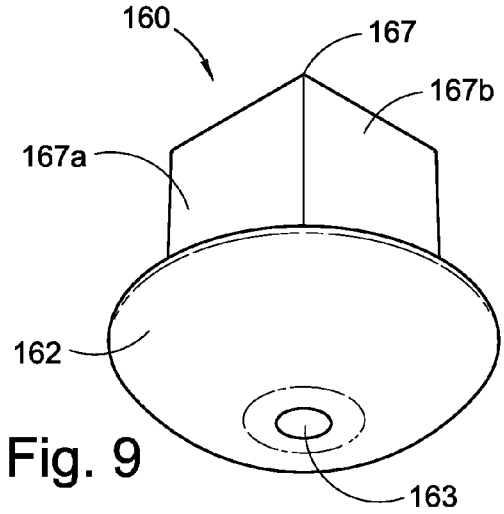
FIG. 9 is a bottom perspective view of the bottom portion.
Figure 10:
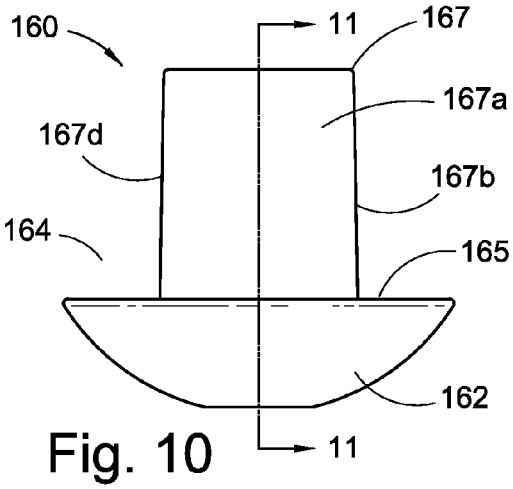
FIG. 10 is a front elevational view of the bottom portion.
Figure 11:
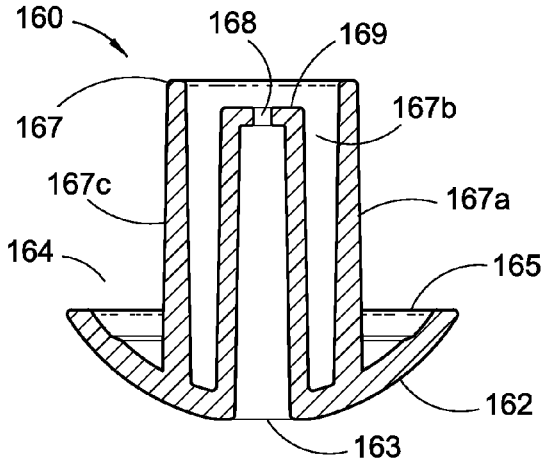
FIG. 11 is a cross-sectional view taken generally along line 11 -11 in FIG. 10.
Figure 12:
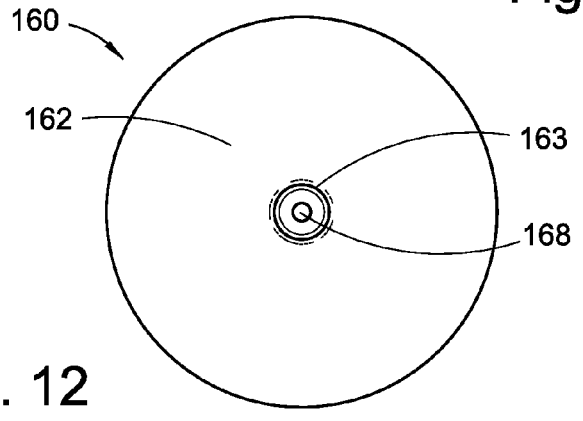
FIG. 12 is a bottom plan view of the bottom portion.
Figure 13:
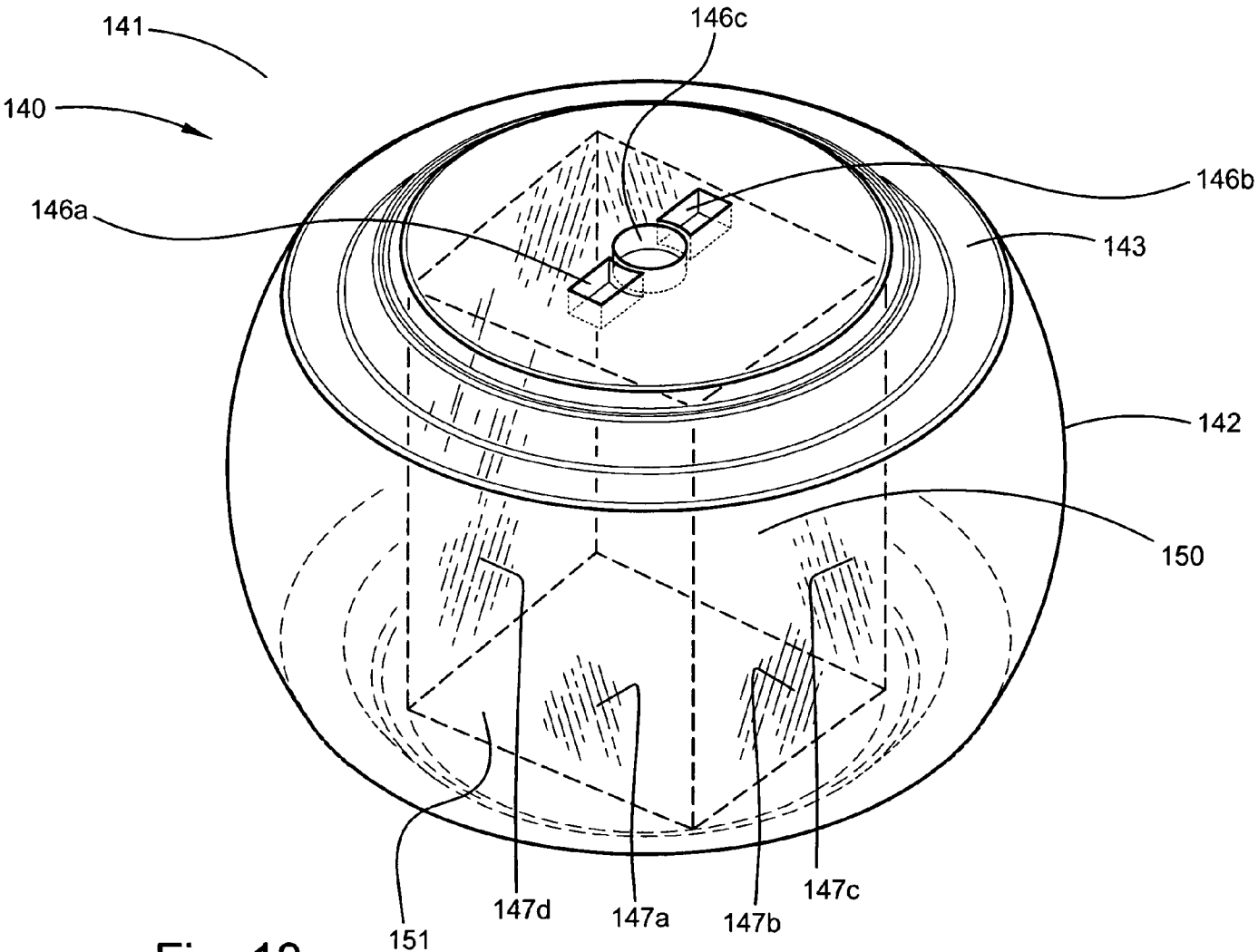
FIG. 13 is a top perspective view of a middle portion of the photo display device.
Figure 14:
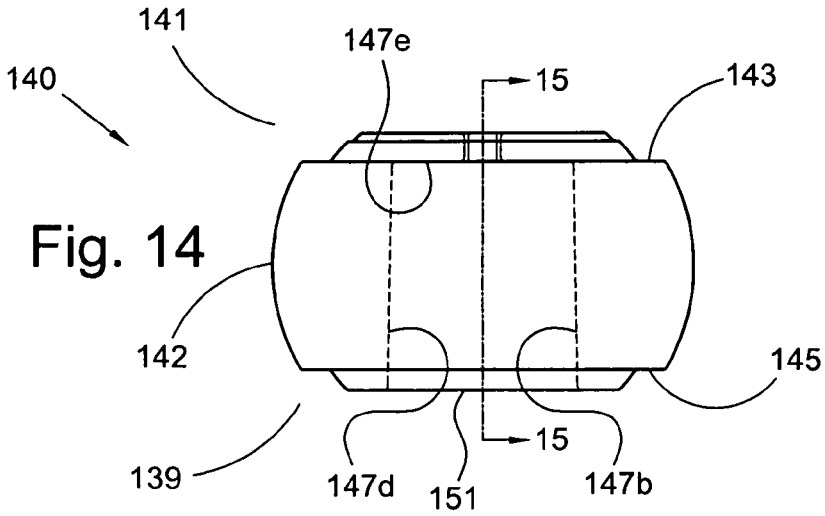
FIG. 14 is a front elevational view of the middle portion.
Figure 15:
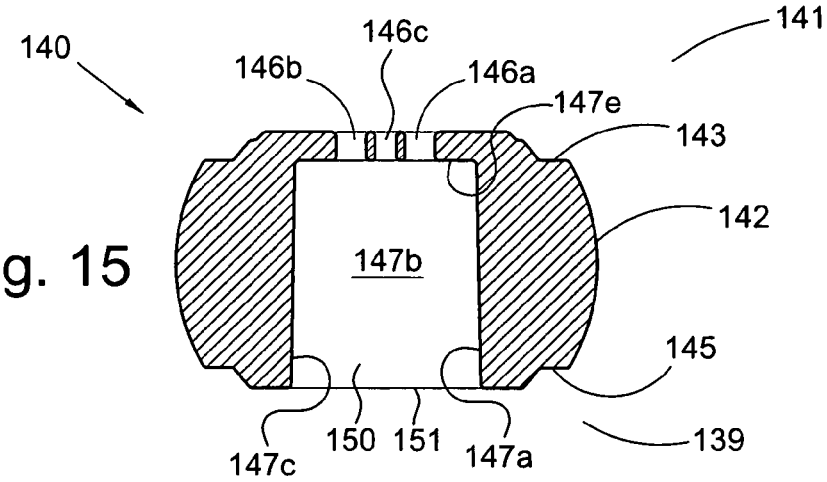
FIG. 15 is a cross-sectional view taken generally along line 15-15 in FIG. 14.

FIG. 1 is a top perspective view of display device 100, and FIG. 2 is an exploded top perspective view of display device 100. Display device 100 generally comprises top portion 120, bottom portion 160, and middle portion 140. In this embodiment, top portion 120, middle portion 140, and bottom portion 160, when assembled as display device 100, form a generally spheroid shape. In a preferred embodiment, display device 100 includes string 105.

Figure 16:
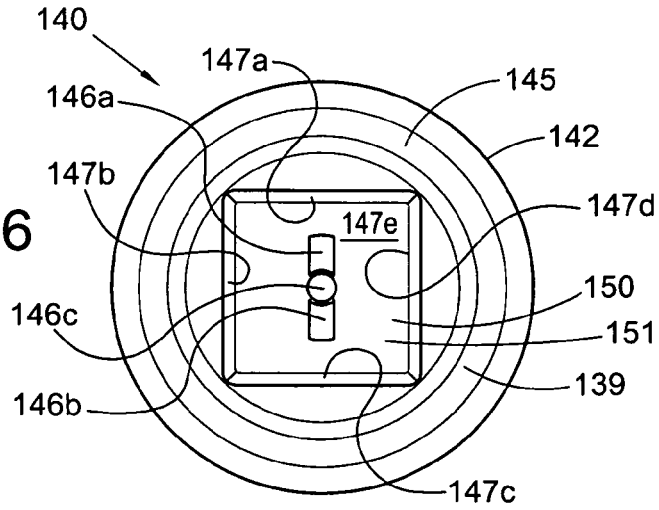
FIG. 16 is a top plan view of the middle portion.
Figure 18:
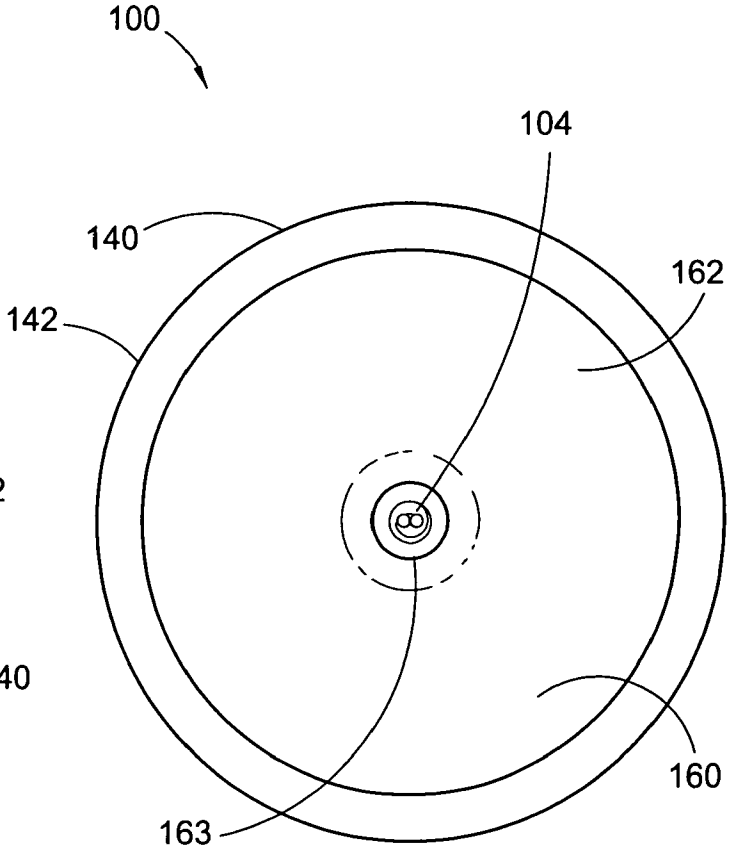
FIG. 18 is a bottom plan view of the photo display device.
Figure 17:
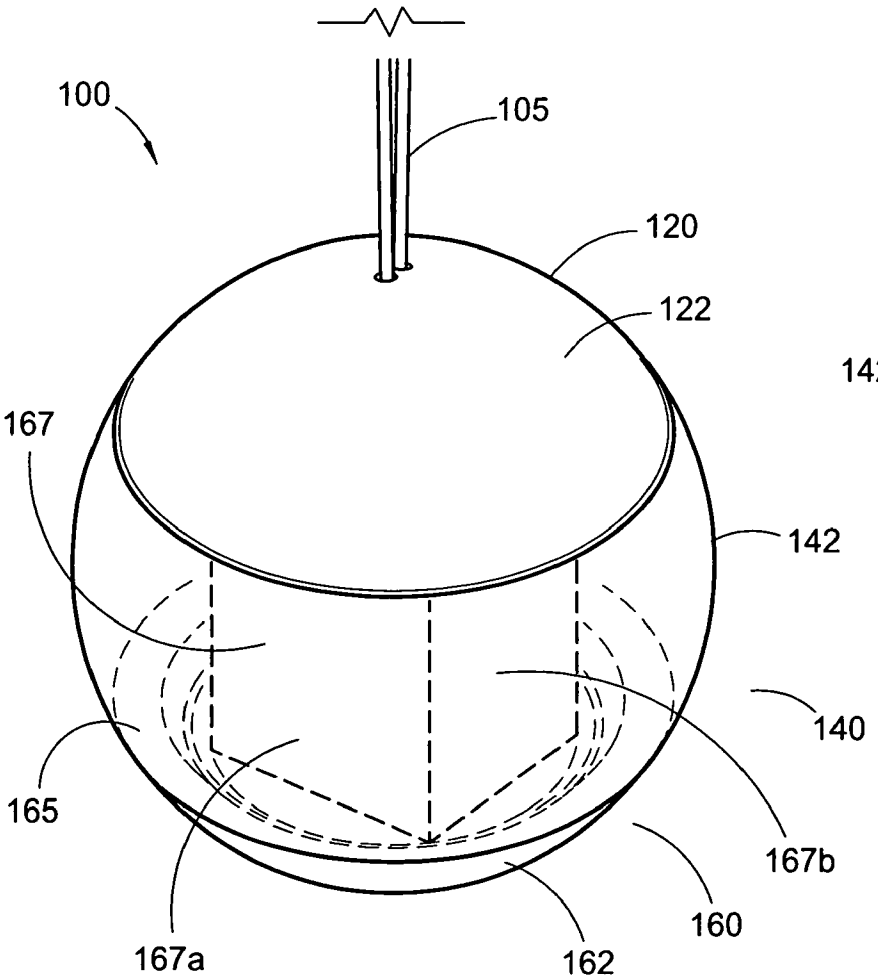
FIG. 17 is a top perspective of the top portion, the middle portion, and the bottom portion assembled as the photo display device.
Figure 20:
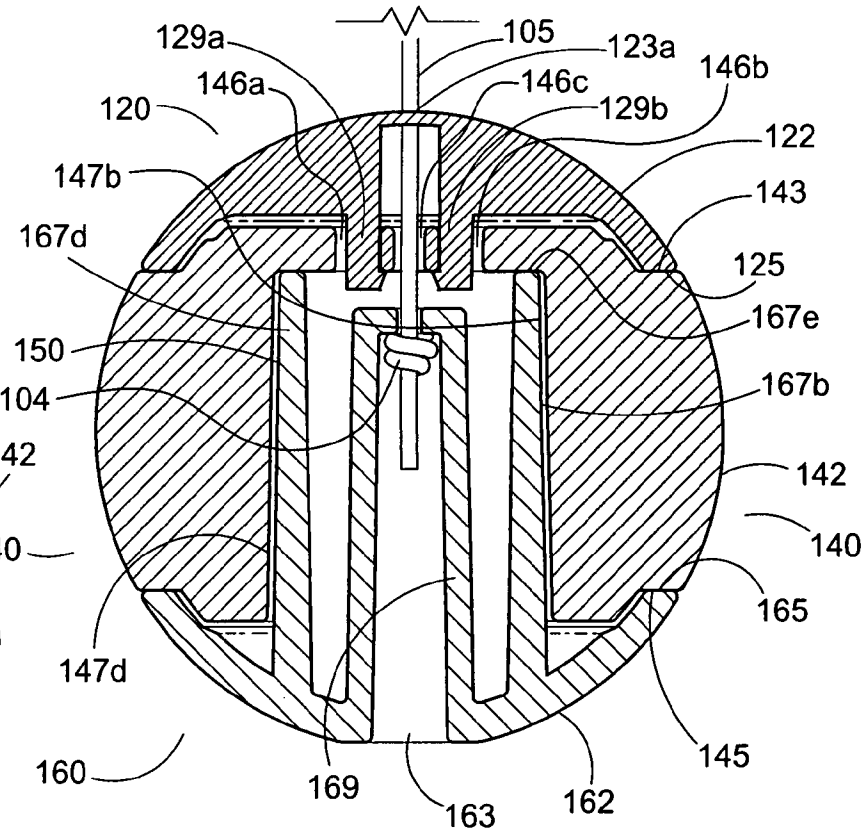
FIG. 20 is a cross-sectional view taken generally along line 20-20 in FIG. 19.
Figure 19:
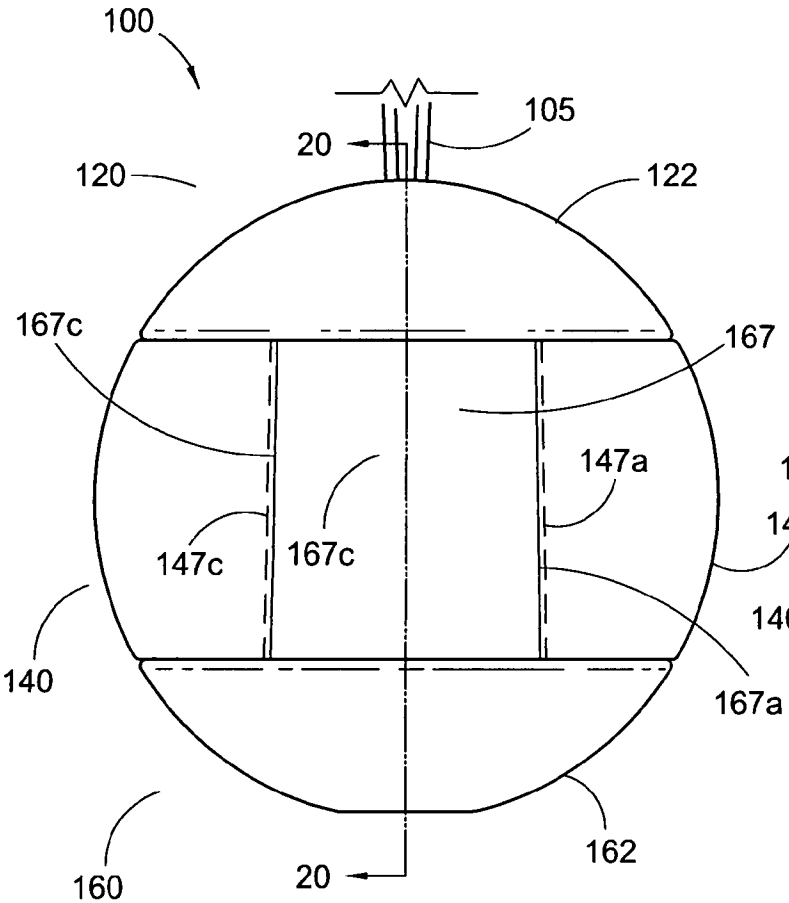
FIG. 19 is a left side elevational view of the photo display device.

As shown in FIGS. 3-7, top portion 120 generally comprises upper surface 122 and lower surface 124. As display device 100 has a generally spherical shape, top portion 120 is arranged as a spherical cap, wherein upper surface 122 has a generally arcuate curvature. Lower surface 124 may comprise annular surface 125, which is adapted to rest upon upper annular shoulder 143 of middle portion 140, as described below. Top portion 120 may include first member 127*a*, having first toothed end 129*a*, and second member 127*b*, having second toothed end 129*b*, extending downwardly from lower surface 124. First member 127*a* and second member 127*b* are adapted to extend into first aperture 146*a* and second aperture 146*b*, respectively, such that the toothed end, 129*a* and 129*b*, secure top portion 120 to middle portion 140, as shown in FIG. 16. Top portion may also include first bore 123*a* and second bore 123*b*, through which string 105 may extend, as described below.

As shown in FIGS. 8-12, bottom portion 160 generally comprises upper surface 164 and lower surface 162. As display device 100 has a generally spherical shape, bottom portion 160 is arranged as a spherical cap, wherein lower surface 162 has a generally arcuate curvature. Upper surface 164 may comprise annular surface 165, upon which upper lower annular shoulder 145 of middle portion 140 is adapted to rest upon, as described below.

Bottom portion 160 includes cuboid member 167 extending upwardly from upper surface 164. Cuboid member 167 is preferably hollow, to allow string 105 to pass through, and may include hollow column 169 therein. Column 169 includes bore 168 and its interior is accessible through aperture 163 arranged in lower surface 162. As shown in FIG. 16, string 105 is arranged to extend along central axis A-A' through top portion 120, middle portion 140, and terminate within cuboid member 167. String 105 may be secured within column 169 by including a bulge, such as knot 104, in the portion of string 105 arranged within column 169, wherein such bulge is larger than bore 168, thereby disallowing string 105 from being pulled through bore 168. In a preferred embodiment, display device 100 is adapted to hang from string 105 on such bulge arranged within column 169.

Cuboid member 167 comprises first lateral face 167*a*, second lateral face 167*b*, third lateral face 167*c*, fourth lateral face 167*d*, and top edge 167*e*, and is adapted to be inserted within inner chamber 150 of middle portion 140, as described below.

Middle portion 140 comprises a translucent material, such as glass or acrylic, and includes top surface 141, bottom surface 139, lateral outer surface 142, and inner chamber 150. Top surface 141 preferably includes upper annular shoulder 143, upon which annular surface 125 of top portion 120 is adapted to rest. Top surface 141 may also include first aperture 146*a*, second aperture 146*b*, and third aperture 146*c*. As described above, first and second apertures, 146*a* and 146*b*, are adapted to received first and second members, 127*a* and 127*b*, respectively, such that first and second toothed ends, 129*a* and 129*b*, are disposed against top inner surface 147*e* of middle portion 140, thereby securing top portion 120 to middle portion 140, as shown in FIG. 16. Bottom surface 139 preferably includes lower annular shoulder, which is adapted to rest upon annular surface 165 of bottom portion 160.

Cuboid inner chamber 150 is defined by at least first inner lateral surface 147*a*, second inner lateral surface 147*b*, third inner lateral surface 147*c*, and fourth inner lateral surface 147*d*, and may be further defined by top inner surface 147*e*. Each of first, second, third, and fourth inner lateral surfaces, 147*a*, 147*b*, 147*c*, and 147*d*, may be substantially planar or slightly concave. Cuboid inner chamber is accessible via rectangular aperture 151 arranged in bottom surface 139, and is adapted to receive cuboid member 167 therein.

Cuboid member 167 and inner chamber 150 are adapted such that when cuboid member 167 is arranged within inner chamber 150, first lateral face 167*a* faces first inner lateral surface 147*a*, second lateral face 167*b* faces second inner lateral surface 147*b*, third lateral face 167*c* faces third inner lateral surface 147*c*, and fourth lateral face 167*d* faces fourth inner lateral surface 147*d*. Additionally, cuboid member 167 and inner chamber 150 are adapted to hold a substantially planar item between each lateral face facing an inner lateral surface. For example, as shown in FIGS. 21-28, first pictorial item 20 is held between first lateral face 167*a* and first inner lateral surface 147*a*, and second pictorial item 30 is held between second lateral face 167*b* and second inner lateral surface 147*b*.

The middle portion of the present invention includes a lateral outer surface having an elliptical curvature. For example, middle portion 140 includes lateral outer surface 142 having an arcuate curvature. Since each of first, second, third, and fourth inner lateral surfaces, 147*a*, 147*b*, 147*c*, and 147*d*, may be substantially planar or slightly concave, and outer surface 142 has an elliptical curvature, each inner later surface forms a plano-convex lens or a positive meniscus lens with outer surface 142, depending on whether the inner lateral surface is substantially planar or slightly concave. Accordingly, middle portion 140 is adapted to magnify a pictorial item held between a lateral face facing an inner lateral surface, as shown in FIGS. 21-28.

The middle portion's arrangement of four inner lateral surfaces and elliptical outer surface also provides a novel visual effect involving the aforementioned magnification and the optical phenomenon of total internal reflection. Total internal reflection is an optical phenomenon that occurs when a ray of light strikes a medium boundary at an angle larger than the critical angle with respect to the normal to the surface. If the refractive index is lower on the other side of the boundary no light can pass through, so effectively all of the light is reflected. For example, total internal reflection will occur when passing from glass to air, but not when passing from air to glass. The critical angle is the angle of incidence above which the total internal reflection occurs.

The following description of the aforementioned novel visual effect is best understood in the views of FIGS. 21-28. FIGS. 21, 23, 25, and 27 are each elevational views of middle portion 140 and bottom portion 160 holding and displaying first pictorial item 20 and second pictorial item 30. Moreover, FIGS. 21, 23, 25, and 27 show first and/or second pictorial items, 20 and 30, as would be perceived by a user arranged at first, second, third, and fourth elevational viewing perspectives, VP1, VP2, VP3, and VP4, respectively.

In FIGS. 22, 24, 26, and 28, the dashed circle VP represents the complete set of elevational viewing perspectives from a particular distance around middle portion 140 and bottom portion 160, as shown in FIGS. 21, 23, 25, and 27. Additionally first, second, third, and fourth viewing perspectives, VP1, VP2, VP3, and VP4, respectively, are each a particular elevational viewing perspective within set VP. FIGS. 22, 24, 26, and 28 are schematic representations of the passage of light rays through middle portion 140 as would be perceived by a user arranged at first, second, third, and fourth viewing perspectives, VP1, VP2, VP3, and VP4, respectively.

Figure 21:
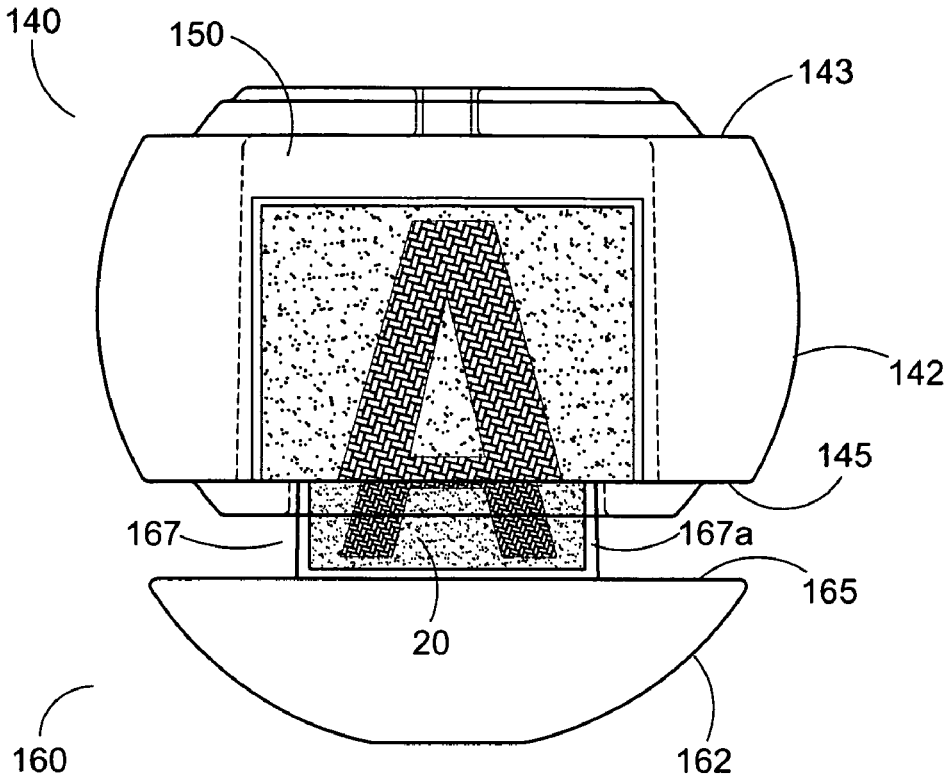
FIG. 21 is an elevational view from a first viewing perspective of a first pictorial item held between the bottom portion and the middle portion, and illustrating the magnification of the first pictorial item by the middle portion.
Figure 22:
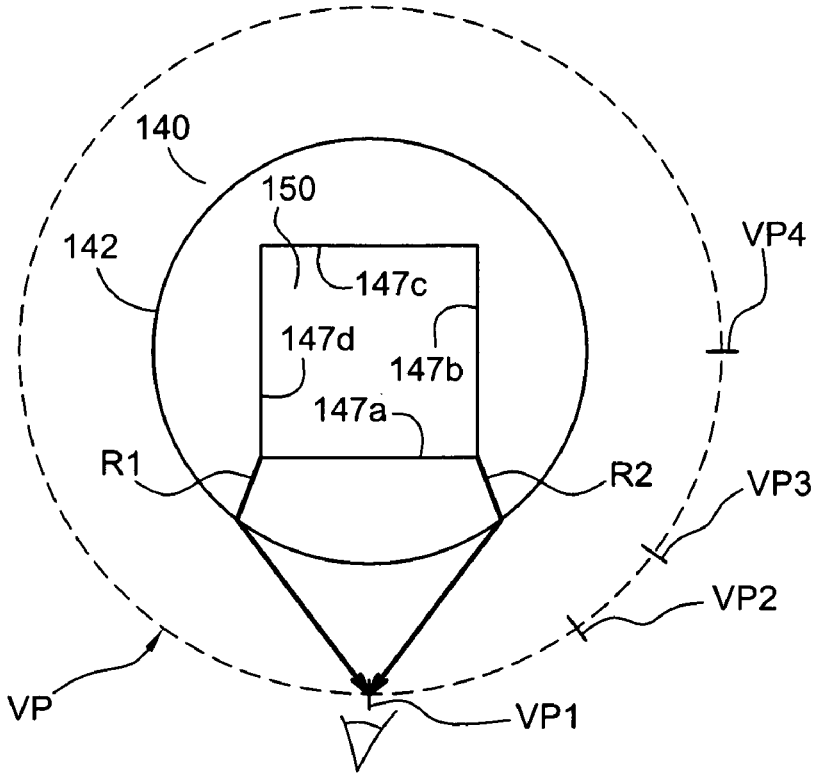
FIG. 22 is a schematic representation of the passage of light reflected off the first pictorial item, through the middle portion, as would be perceived from the first viewing perspective.

In particular, FIG. 21 is an elevational view at first viewing perspective VP1 of first pictorial item 20 held between first lateral face 167*a* and first lateral inner surface 147*a*. FIG. 22 is a schematic representation of the passage of light reflected off first pictorial item 20, through middle portion 140, as would be perceived from first viewing perspective VP1. As shown in FIG. 21, bottom portion 160 and first pictorial item 20 are only partially inserted within inner chamber 150 in order to illustrate the relative magnification of first pictorial item 20 by middle portion 140. In FIG. 22, first light ray R1 and second light ray R2 represent the outer boundaries of light reflected off first pictorial item 20, refracted at outer surface 142, and forming the left and right outer boundaries of the magnified image of first pictorial item 20 at first viewing perspective VP1, as shown in FIG. 21. It should be assumed that light reflected off first pictorial item 20 between first and second light rays, R1 and R3, is refracted at outer surface 142 and forms the complete magnified image of first pictorial item 20 at first viewing perspective VP1, as shown in FIG. 21.

Figure 23:
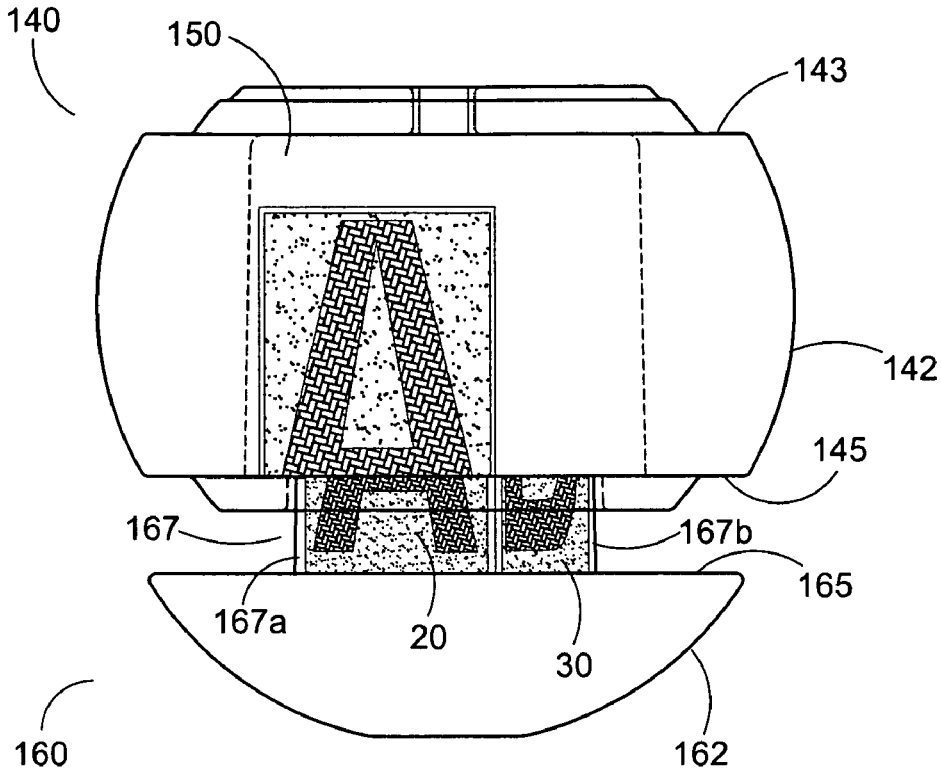
FIG. 23 is an elevational view from a second viewing perspective of the first pictorial item and a second pictorial item held between the bottom portion and the middle portion, and illustrating the magnification of the first pictorial item and total internal reflection of light obscuring the second pictorial item, by the middle portion.

FIG. 23 is an elevational view at second viewing perspective VP2 of middle portion 140 and bottom portion 160 shown holding and displaying first pictorial item 20 between first lateral face 167*a* and first lateral inner surface 147*a* and second pictorial item 30 between second lateral face 167*b* and second lateral inner surface 147*b*. Bottom portion 160, first pictorial item 20, and second pictorial item 30 are only partially inserted within inner chamber 150 in order to illustrate the relative magnification of first pictorial item 20 and the total internal reflection of light off second lateral inner surface 147*b*, as would be perceived from the second viewing perspective VP2. Thus, due to the total internal reflection of light off second lateral inner surface 147*b*, second pictorial item 30 is obscured and not perceivable through middle portion 140 at second viewing perspective VP2.

Figure 24:
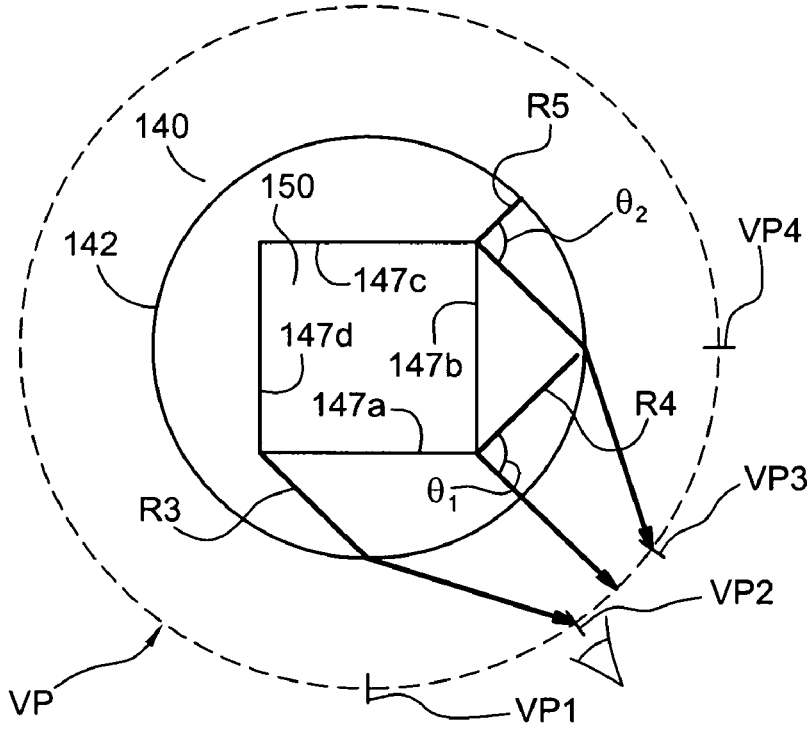
FIG. 24 is a schematic representation of the passage of light reflected off the first pictorial item and a second inner lateral surface, through the middle portion, as would be perceived from the second viewing perspective.
Figure 26:
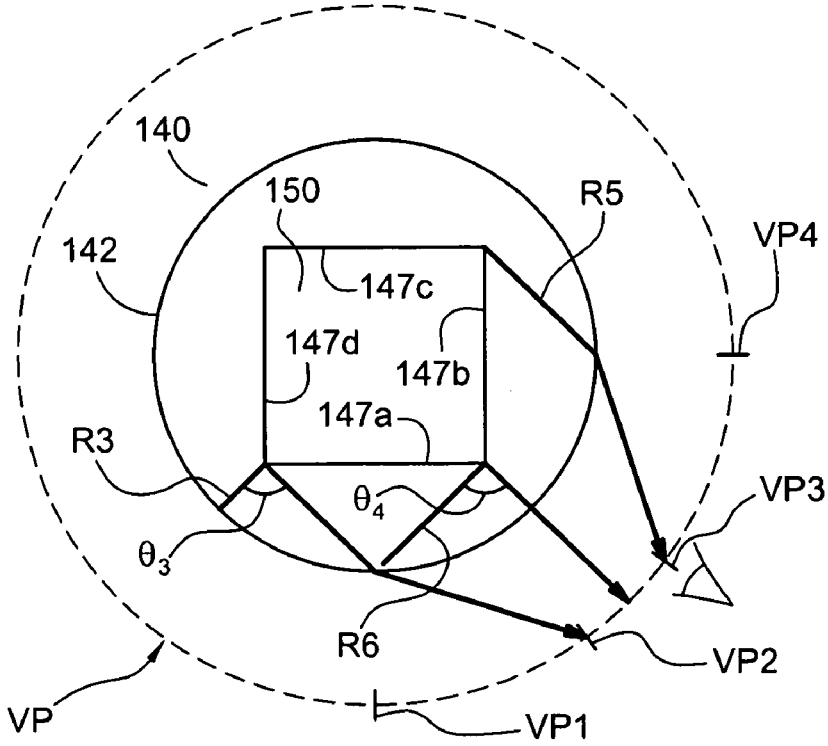
FIG. 26 is a schematic representation of the passage of light reflected off a first inner lateral surface and the second pictorial item, through the middle portion, as would be perceived from the third viewing perspective.

As illustrated in FIGS. 24 and 26, third light ray R3 represents light reflected off the left outer boundary of first lateral inner surface 147*a*, refracted at outer surface 142, and forming the outer boundary of the magnified image of first pictorial item 20 at second viewing perspective VP2, as shown in FIG. 23. Fourth and fifth light rays, R4 and R5, represent light hitting the left and right boundaries, respectively, of second lateral inner surface 147*b* at first and second angles, $\theta_1$ and $\theta_2$, respectively, which are angles of incidence greater than the critical angle for the boundary of air in inner chamber 150 and second lateral inner surface 147*b*. Since second viewing perspective VP2 is arranged, relative to second lateral inner surface 147*b*, at angles greater than first and second angles, $\theta_1$ and $\theta_2$, all the light perceived at second viewing perspective VP2 from the direction of second pictorial item 30 is light reflected off second lateral inner surface 147*b*, and therefore no image of second pictorial item 30 can be perceived through middle portion 140 at second viewing perspective VP2, as illustrated in FIG. 23.

Figure 25:
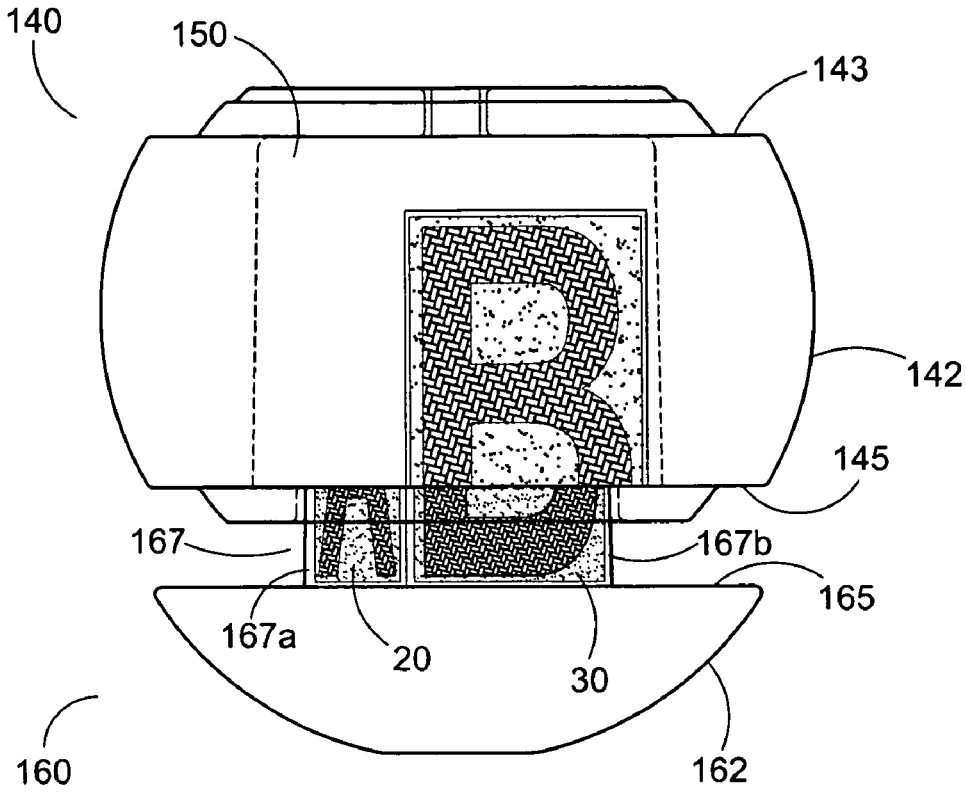
FIG. 25 is an elevational view from a third viewing perspective of the first pictorial item and the second pictorial item held between the bottom portion and the middle portion, and illustrating total internal reflection of light obscuring the first pictorial item and the magnification of the second pictorial item, by the middle portion.

FIG. 25 is an elevational view at third viewing perspective VP3 of middle portion 140 and bottom portion 160 shown holding and displaying first pictorial item 20 between first lateral face 167*a* and first lateral inner surface 147*a* and second pictorial item 30 between second lateral face 167*b* and second lateral inner surface 147*b*. Bottom portion 160, first pictorial item 20, and second pictorial item 30 are only partially inserted within inner chamber 150 in order to illustrate the relative magnification of second pictorial item 30 and the total internal reflection of light off first lateral inner surface 147*a*, as would be perceived from the second viewing perspective VP2. Thus, due to the total internal reflection of light off first lateral inner surface 147*a*, first pictorial item 20 is obscured and not perceivable through middle portion 140 at third viewing perspective VP3.

As illustrated in FIGS. 24 and 26, fifth light ray R5 represents light reflected off the right outer boundary of second lateral inner surface 147*b*, refracted at outer surface 142, and forming the outer boundary of the magnified image of second pictorial item 30 at third viewing perspective VP3, as shown in FIG. 25. Third and sixth light rays, R3 and R6, represent light hitting the left and right boundaries, respectively, of first lateral inner surface 147*a* at third and fourth angles, $\theta_3$ and $\theta_4$, respectively, which are angles of incidence greater than the critical angle for the boundary of air in inner chamber 150 and first lateral inner surface 147*a*. Since third viewing perspective VP3 is arranged, relative to first lateral inner surface 147*a*, at angles greater than third and fourth second angles, $\theta_3$ and $\theta_4$, all the light perceived at third viewing perspective VP3 from the direction of first pictorial item 20 is light reflected off first lateral inner surface 147*a*, and therefore no image of first pictorial item 20 can be perceived through middle portion 140 at third viewing perspective VP3, as illustrated in FIG. 25.

Figure 27:
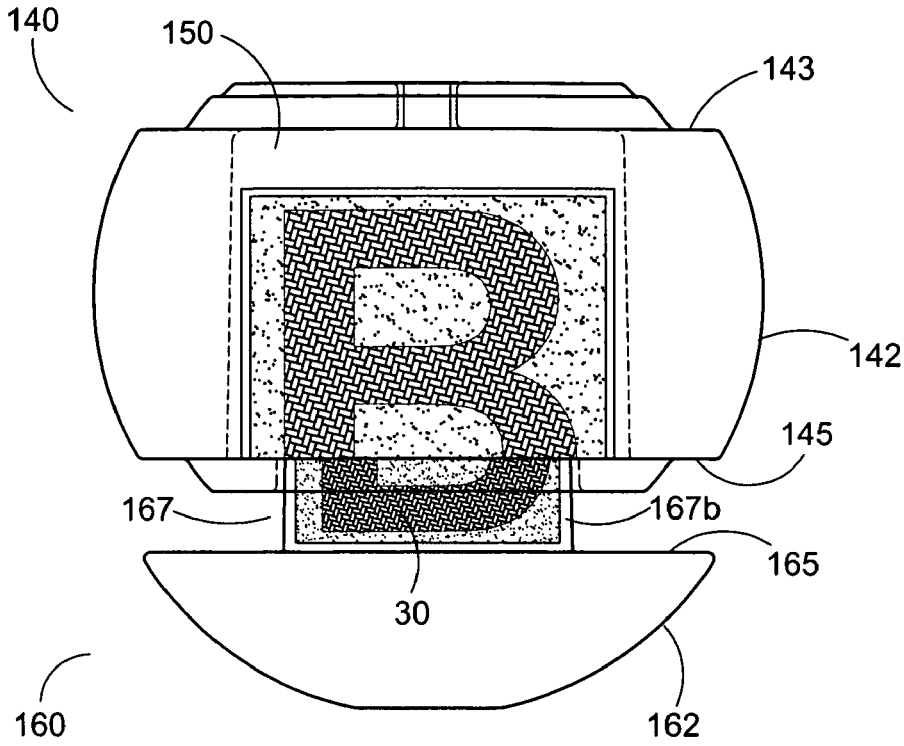
FIG. 27 is an elevational view from a fourth viewing perspective of the second pictorial item held between the bottom portion and the middle portion, and illustrating the magnification of the second pictorial item by the middle portion; and, FIG. 28 is a schematic representation of the passage of light reflected off the second pictorial item, through the middle portion, as would be perceived from the fourth viewing perspective.
Figure 28:
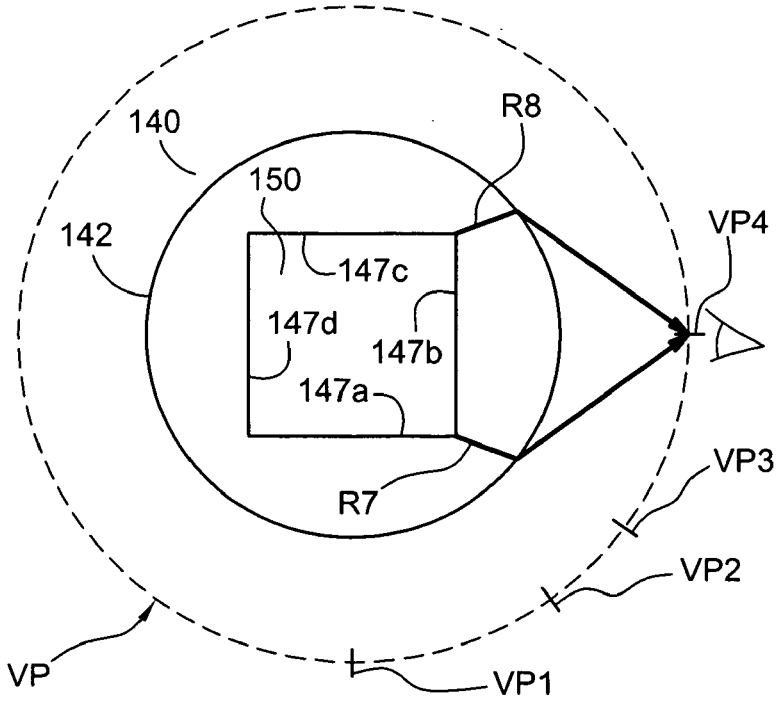

FIG. 27 is an elevational view at fourth viewing perspective VP4 of second pictorial item 30 held between second lateral face 167*b* and second lateral inner surface 147*b*. FIG. 28 is a schematic representation of the passage of light reflected off second pictorial item 30, through middle portion 140, as would be perceived from fourth viewing perspective VP4. As shown in FIG. 27, bottom portion 160 and second pictorial item 30 are only partially inserted within inner chamber 150 in order to illustrate the relative magnification of second pictorial item 30 by middle portion 140. In FIG. 28, seventh light ray R7 and eighth ray R8 represent the outer boundaries of light reflected off second pictorial item 30, refracted at outer surface 142, and forming the left and right outer boundaries of the magnified image of second pictorial item 30 at fourth viewing perspective VP4, as shown in FIG. 27. It should be assumed that light reflected off second pictorial item 30 between seventh and eighth light rays, R7 and R8, is refracted at outer surface 142 and forms the complete magnified image of second pictorial item 30 at fourth viewing perspective VP4, as shown in FIG. 27.

It should be appreciated that the aforementioned obscuring of pictorial items held between the cuboid member and the middle portion by the total internal reflection provides a unique visual effect wherein images seem to appear and disappear as a user rotates the photo display device while viewing it. Such unique visual effect is produced by the cuboid arrangement of the lateral inner surfaces relative to the elliptical outer surface of the middle portion. It should also be appreciated that the aforementioned magnification and reflection is not demonstrated in FIGS. 1, 17, and 19 so that the internal structure of the display device may be clearly ascertained.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

I claim:

1. A photo display device comprising:

a top portion;

a bottom portion having an upper surface and a cuboid member extending upwardly from the upper surface; and, a middle portion comprising: a translucent material; a lateral outer surface having an elliptical curvature; a cuboid inner chamber defined by an inner surface and adapted to receive the cuboid member therein, wherein the top portion, the middle portion, and the bottom portion are adapted to be assembled as the photo display device such that the top portion rests upon the middle portion and the middle portion rests upon the bottom portion, and wherein the photo display device is adapted to hold at least one substantially planar item between the cuboid member and the inner surface, and the middle portion is adapted to magnify the at least one substantially planar item when the at least one substantially planar item is held between the cuboid member and the inner surface.

2. The photo display device recited in claim 1 wherein the photo display device is adapted hold four substantially planar items between the cuboid member and the inner surface, and the middle portion is adapted to magnify each of the four substantially planar items when each of the four substantially planar items is held between the cuboid member and the inner surface.

3. The photo display device recited in claim 1 wherein the top portion comprises a first spheroid cap having an elliptical upper surface, the bottom portion comprises a second spheroid cap having an elliptical lower surface, and the photo display device is generally spheroid having an elliptical outer surface.

4. The photo display device recited in claim 1 wherein the cuboid member comprises a first lateral face, a second lateral face, a third lateral face, and a fourth lateral face, the inner surface of the middle portion comprises a first lateral inner surface, a second lateral inner surface, a third lateral inner surface, and a fourth lateral inner surface, and the inner chamber is adapted to receive the cuboid member such that the first lateral face faces the first lateral inner surface, the second lateral face faces the second lateral inner surface, the third lateral face faces the third lateral inner surface, and the fourth lateral face faces the fourth lateral inner surface.

5. The photo display device recited in claim 1 wherein the inner surface of the middle portion comprises a first lateral inner surface, a second lateral inner surface, a third lateral inner surface, and a fourth lateral inner surface, and each of the first, second, third, and fourth lateral inner surfaces is arranged to form a plano-convex lens or a positive meniscus lens with the lateral outer surface of the middle portion.

6. The photo display device recited in claim 1 further comprising a string extending through the top portion, the middle portion, and the bottom portion along a central axis of the photo display device, wherein the string includes a bulge and the bottom portion is adapted to rest upon the bulge.

* * * * *